US010631637B2

(12) United States Patent
Lucas

(10) Patent No.: US 10,631,637 B2
(45) Date of Patent: Apr. 28, 2020

(54) DEVICE FOR RELEASABLY CONNECTING A FURNITURE DRAWER TO A GUIDANCE UNIT THAT MOVEABLY GUIDES THE DRAWER IN A FURNITURE BODY

(71) Applicant: Grass GmbH, Höchst (AT)

(72) Inventor: Tim Lucas, Leinfelden-Echterdingen (DE)

(73) Assignee: Grass GmbH, Höchst (AT)

( * ) Notice: Subject to any disclaimer, the term of this patent is extended or adjusted under 35 U.S.C. 154(b) by 388 days.

(21) Appl. No.: 15/286,019

(22) Filed: Oct. 5, 2016

(65) Prior Publication Data

US 2017/0095082 A1 Apr. 6, 2017

(30) Foreign Application Priority Data

Oct. 5, 2015 (DE) ..... 20 2015 006 934 U

(51) Int. Cl.
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4278* (2017.01); *A47B 2210/0054* (2013.01)

(58) Field of Classification Search
CPC . A47B 88/0422; A47B 88/407; A47B 88/427; A47B 2088/0437; A47B 2088/4278; A47B 2210/0054
See application file for complete search history.

(56) References Cited

U.S. PATENT DOCUMENTS 6,913,334 B2 * 7/2005 Weichelt ..... A47B 88/427 312/330.1
8,727,460 B2 * 5/2014 Grabher ..... E05F 5/02 312/333

(Continued)

FOREIGN PATENT DOCUMENTS

CN 101396207 A 4/2009
CN 102525151 A 7/2012

(Continued)

OTHER PUBLICATIONS

Search Report in corresponding German Patent Application No. 202015006934.7, dated Sep. 5, 2016, with English translation.

(Continued)

*Primary Examiner* — Daniel J Troy
*Assistant Examiner* — Ryan A Doyle
(74) *Attorney, Agent, or Firm* — Edell, Shapiro & Finnan, LLC

(57) ABSTRACT

A device for releasably connecting a furniture drawer to a guidance unit that movably guides the drawer in a furniture body of an item of furniture comprises a base portion; and a displacement device arranged on the base portion and comprising a plurality of components moveable relative to each other, the displacement device enabling a position of the furniture pull-out to be adjusted in at least one spatial direction relative to the guidance unit, wherein the components of the displacement device are arranged as a preassembled subassembly that is releasably securable to the base portion at a securing interface.

4 Claims, 5 Drawing Sheets

(56) References Cited

U.S. PATENT DOCUMENTS

| | | | | |
|---|---|---|---|---|
| 8,991,952 | B2 * | 3/2015 | Salice | A47B 88/427 312/334.4 |
| 2013/0154463 | A1 | 6/2013 | Henscheid et al. | |
| 2014/0175965 | A1 * | 6/2014 | Salice | A47B 88/427 312/334.1 |
| 2014/0314347 | A1 | 10/2014 | Huang | |
| 2017/0095081 | A1 * | 4/2017 | Lucas | A47B 88/407 |
| 2017/0095083 | A1 * | 4/2017 | Lucas | A47B 88/427 |
| 2017/0181544 | A1 * | 6/2017 | McGregor | A47B 88/427 |

FOREIGN PATENT DOCUMENTS

| | | | | |
|---|---|---|---|---|
| CN | 102724897 | A | 10/2012 | |
| CN | 103200845 | A | 7/2013 | |
| CN | 103501657 | A | 1/2014 | |
| CN | 103607928 | A | 2/2014 | |
| CN | 204181228 | U | 3/2015 | |
| DE | 3931155 | A1 | 3/1991 | |
| DE | 202009017319 | U1 * | 5/2011 | E05F 5/02 |
| DE | 202009017319 | U1 | 5/2011 | |
| DE | 202011104673 | U1 | 11/2012 | |
| DE | 102013104830 | A1 | 11/2014 | |
| DE | 212013000112 | U1 * | 12/2014 | A47B 88/427 |
| DE | 212013000112 | U1 | 12/2014 | |
| EP | 0695523 | B1 | 2/1996 | |
| EP | 2762037 | A | 8/2014 | |
| WO | 2011094776 | B1 | 8/2011 | |
| WO | 2012079793 | A1 | 6/2012 | |

OTHER PUBLICATIONS

European Search Report in corresponding European Patent Application No. 16190979, dated Jan. 11, 2017, with English translation.
Office Action, dated Jan. 21, 2019, in corresponding Chinese Patent Application No. 201610874809.6, along with a Search Report dated Jan. 11, 2019, with English translation.

* cited by examiner

DEVICE FOR RELEASABLY CONNECTING A FURNITURE DRAWER TO A GUIDANCE UNIT THAT MOVEABLY GUIDES THE DRAWER IN A FURNITURE BODY

CROSS REFERENCE TO RELATED APPLICATIONS

This application claims foreign priority under 35 U.S.C. § 119(a)-(d) to German Patent Application No. DE 202015006934.7 filed on Oct. 5, 2015, the entire contents of which are hereby incorporated by reference.

FIELD OF THE INVENTION

The invention relates to a device for releasably connecting a furniture pull-out such as a drawer to a guidance unit that movably guides the drawer in a furniture body. The device includes a base portion on which there is arranged a displacement device which belongs to the device and which comprises a plurality of components which can be moved relative to each other and by which a position of the furniture drawer which is connected to the guidance unit can be adjusted relative to the guidance unit in at least one spatial direction with respect to the guidance unit.

BACKGROUND

A device of this type is known, for example, from EP 0695 523 B1 or alternatively from DE 20 2011 104 673. Such devices serve to couple the guidance unit to a furniture drawer so that the furniture drawer, for example, drawer member, can be separated from the guidance unit when required.

It can thereby be removed independently from the furniture body, whereby it is possible to assemble the guidance unit remaining in the body.

Such devices, in addition to coupling the furniture drawer and guidance unit, further serve to adjust the position of the furniture drawer with respect to the guidance unit. This is important in order to adjust at the front of the furniture drawer in the closure position thereof a uniform joint appearance or uniform gap widths between the edges of the front of the furniture drawer and the furniture body surrounding them. To this end, it is possible to adjust the furniture drawer via the device in terms of height or also laterally. Furthermore, an inclination or depth adjustment of the furniture drawer with respect to the guidance unit is conceivable.

It is possible to provide the device or coupling with a displacement device which permits displacement only in one of the spatial directions or alternatively to provide it with a displacement device which enables displacement in a plurality of spatial directions, for example, two or three spatial directions.

SUMMARY

The object of the invention is to provide a device of the type mentioned in the introduction which can be used in a more flexible manner compared with the devices known from the prior art.

This object is achieved with a device for releasably connecting a furniture drawer, which is movably guided by a guidance unit in a furniture body of an item of furniture, to the guidance unit.

The device according to the invention is characterized in that the components of the displacement device are combined to form a subassembly which can be preassembled and which can be handled in a uniform manner and which can be or is releasably secured to the base portion at a securing interface.

As a result of the subassembly which can be pre-assembled and which can be handled in a uniform manner, it is possible to assemble the displacement device in a quite individual manner for the required application. For example, it is possible to preassemble a displacement device which is suitable only for the displacement of a furniture drawer with respect to the guidance unit in one spatial direction or alternatively to equip the displacement device in such a manner that a displacement in several spatial directions is possible. The basic component of the device always remains the same, only the subassembly which can be pre-assembled and which is then subsequently secured at the securing interface to the base portion or the basic component can then be individually assembled.

In a development of the invention, the displacement device has a lateral displacement unit for adjusting the position of the furniture drawer relative to the guidance unit transversely relative to a longitudinal direction of the guidance unit, wherein the components of the lateral displacement unit which are combined to form the subassembly comprise an adjustment element and a coupling member which can be moved relative to the adjustment element and which is coupled or can be coupled to the guidance unit for lateral displacement of the furniture drawer with respect to the guidance unit.

In a particularly preferred manner, the adjustment element is constructed as an adjustment wheel. Advantageously, the coupling member has a threaded shaft on which the adjustment wheel is screwed, wherein the coupling member with the screwed-on adjustment wheel forms the subassembly which in this state can be secured or is secured to the base portion at the securing interface.

It is possible for the securing interface on the base portion to be configured for tool-free releasable securing of the subassembly. Rapid and simple securing of the subassembly to the base portion is thereby possible. The subassembly can also be quickly and readily disassembled from the base portion if required.

Advantageously, the base portion has an assembly side which is associated with the furniture drawer and on which the securing interface is located. The base portion can thus be assembled with the assembly side on the associated portion on the furniture drawer. The securing interface is in this instance covered by the furniture drawer so that the subassembly which is secured thereto is protected, in particular from damage or unintentional release.

In a development of the invention, the securing interface has a bearing receiving member which is constructed on the base portion for supporting the subassembly.

In a particularly preferred manner, the bearing receiving member has catch mechanism for tool-free engagement of the subassembly. The subassembly can be secured to the securing interface of the base portion in a simple manner with a catch connection, snap-fitting connection or clip-fit connection.

In a development of the invention, the catch mechanism has two resilient catch webs which protrude away from the base portion and which are arranged so as to face each other and which have catch projections which protrude towards each other in such a manner that the two catch webs are in each case pressed outwards when an associated component of the subassembly is introduced and, after the associated component has passed the catch projections, snap back again, wherein the catch projections engage behind the associated component and secure it to the base portion.

It is possible for the base portion to have a recess in which the bearing receiving member is arranged.

Advantageously, the recess is located at the assembly side of the base portion.

It is possible for the base portion and/or the subassembly to comprise plastics material, in particular to be injection-molded plastics components.

In a development of the invention, the catch webs of the bearing receiving members are integrally formed on the remainder of the base portion.

The invention further comprises an item of furniture, having a furniture drawer which can be moved relative to a furniture body and which is guided by a guidance unit and which is distinguished by the aforementioned device.

BRIEF DESCRIPTION OF THE DRAWINGS

A preferred embodiment of the invention is illustrated in the drawings and is explained below. In the drawings.

DETAILED DESCRIPTION

Figure 1:
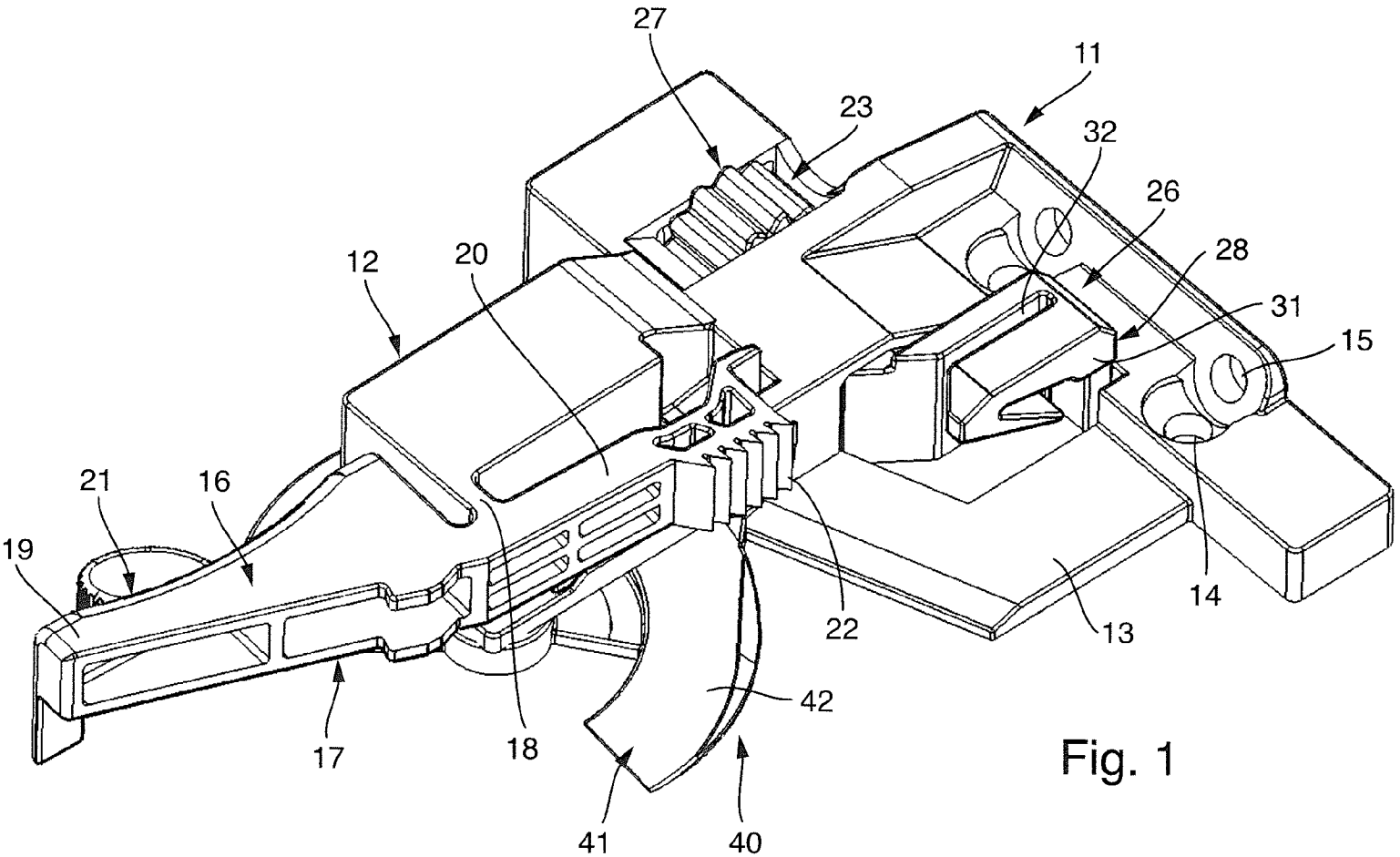
FIG. 1 is a perspective view of an example embodiment of the device according to the invention.

FIGS. 1 to 6 show an example embodiment of the device 11 according to the invention which is used for releasable connections of a furniture pull-out such as a drawer, which is movably guided by a guidance unit (not illustrated) in a furniture body of an item of furniture, to the guidance unit.

The device 11 is explained below by way of example with reference to a furniture drawer which is constructed as a drawer member.

The drawer is displaceably supported relative to the furniture body by the at least one guidance unit. There are advantageously provided a plurality of guidance units of which two mutually opposing side edges of the drawer are associated. The guidance units may be components of a so-called under-floor guiding system, in which the guidance units are associated with the drawer base. Alternatively, it would be possible to integrate the guidance units in the side wall or frame of the drawer. The device 11 according to the invention acts as a connection member between the guidance unit and the drawer. Therefore, the device 11 could also be referred to as a coupling.

The device 11 has a housing-like base portion 12 which comprises plastics material and which is advantageously produced by injection-molding of plastics material. The base portion 12 has a base plate 13 with guiding openings 14 for securing to the base of a drawer member by suitable fasteners, for example, screws. The end face of the base plate 13 is expanded with respect to the remainder of the base plate 13, wherein at the end face which is substantially perpendicular relative to the base plate 13 there are provided through-holes 15, by which a securing is possible at a side wall which protrudes downwards beyond the base or at the front, in particular front panel, of the drawer member. An elongate bearing portion 16 rises above the base plate 13 of the base portion 12.

Another component of the device 11 is a lever-like adjustment element 17 which is formed by at least one flexure joint 18 on the bearing portion 16 of the base portion 12. The adjustment element 17 also comprises plastics material and is also injected at the same time onto the base portion 12 during production. Advantageously, the adjustment element 17 comprises the same plastics material, whereby the production costs are low since it can be produced by single-component injection-molding.

The adjustment element 17 is supported so as to be pivotably movable by the flexure joint 18 on the bearing portion 16. The adjustment element 17 has a manually actuatable actuation portion 19 which is constructed in the manner of a handle. The actuation portion 19 is located at one side of the flexure joint 18, wherein there is provided at the other side an engagement portion 20 which is provided for engagement in complementary engagement portion (not illustrated) on the guidance unit.

As illustrated in particular in FIG. 1, the handle-like actuation portion 19 is constructed in a wedge-like manner, wherein at the outer side of the actuation portion 19 there is provided an actuation face 21 which may optionally extend in a curved manner for the fingers of the user to grip. The engagement portion 20 is provided at the other side of the flexure joint 18 with a catch mechanism in the form of catch teeth 22. The catch teeth 22 on the engagement portion are in the assembly state of the device 11 engaged on the guidance unit by complementary catch teeth (not illustrated), whereby the drawer member is coupled to the guidance unit. Using pressure applied by the fingers of the user to the actuation face 21, the adjustment element can be pivoted in the clockwise direction about the flexure joint 18, wherein the engagement portion pivots with the catch teeth 22 in the direction towards the bearing portion 16 of the base portion 12, whereby catch teeth 22 on the adjustment element 17 move out of engagement with the complementary catch teeth on the guidance unit.

There further belongs to the device 11 an adjustment device 23 which comprises a plurality of components which can be moved relative to each other. As a result of the adjustment device 23, a position of the drawer member which is connected to the guidance unit can be adjusted relative to the guidance unit in at least one spatial direction with respect to the guidance unit.

As can be seen in particular in FIG. 1, the device 11 is constructed as a so-called 2D coupling.

The components of the adjustment device 23 are combined to form a subassembly 24 which can be preassembled and which can be handled in a uniform manner and which can be or is releasably secured to the base portion 12 at a securing interface 25.

In the example shown, the adjustment device 23 comprises a lateral adjustment unit 26 for adjusting the position of the drawer member relative to the guidance unit transversely relative to a longitudinal direction of the guidance unit.

Figure 6:
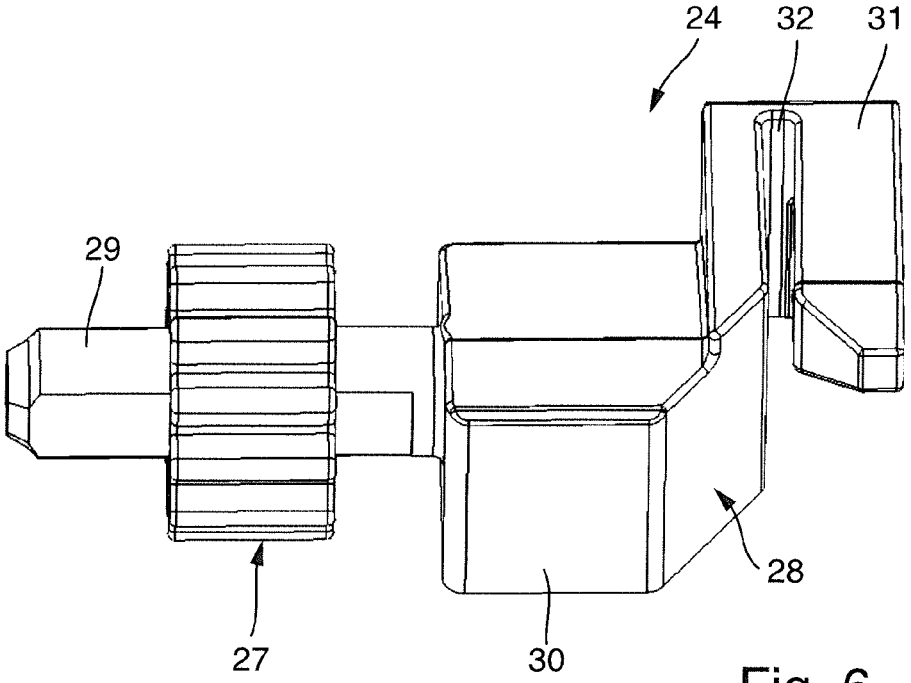
FIG. 6 is a perspective illustration of an embodiment of a subassembly of the displacement device for the device according to the invention.

As illustrated in particular in FIG. 6, the subassembly 24 comprises in the example shown components of the lateral adjustment unit 26, that is to say, an adjustment element 27 and a coupling member 28 which can be moved relative to the adjustment element 27 and which is coupled or can be coupled to the guidance unit for lateral adjustment of the furniture drawer relative to the guidance unit.

As further shown in FIG. 6, the adjustment element 27 is constructed as an adjustment wheel. The coupling member 28 has a threaded shaft 29 on which the adjustment wheel is screwed. The coupling member 28 and the screwed-on adjustment wheel in this instance form the subassembly 24.

As illustrated in particular in FIG. 6, the coupling member 28 also has in addition to the threaded shaft 29 a base portion 30 from which, on the one hand, the threaded shaft 29 extends and to which, on the other hand, a wedge-like coupling portion 31 is fitted.

The coupling member and the screwed-on adjustment wheel are in the same manner as the base portion 12 injection-molded plastics components.

Figure 2:
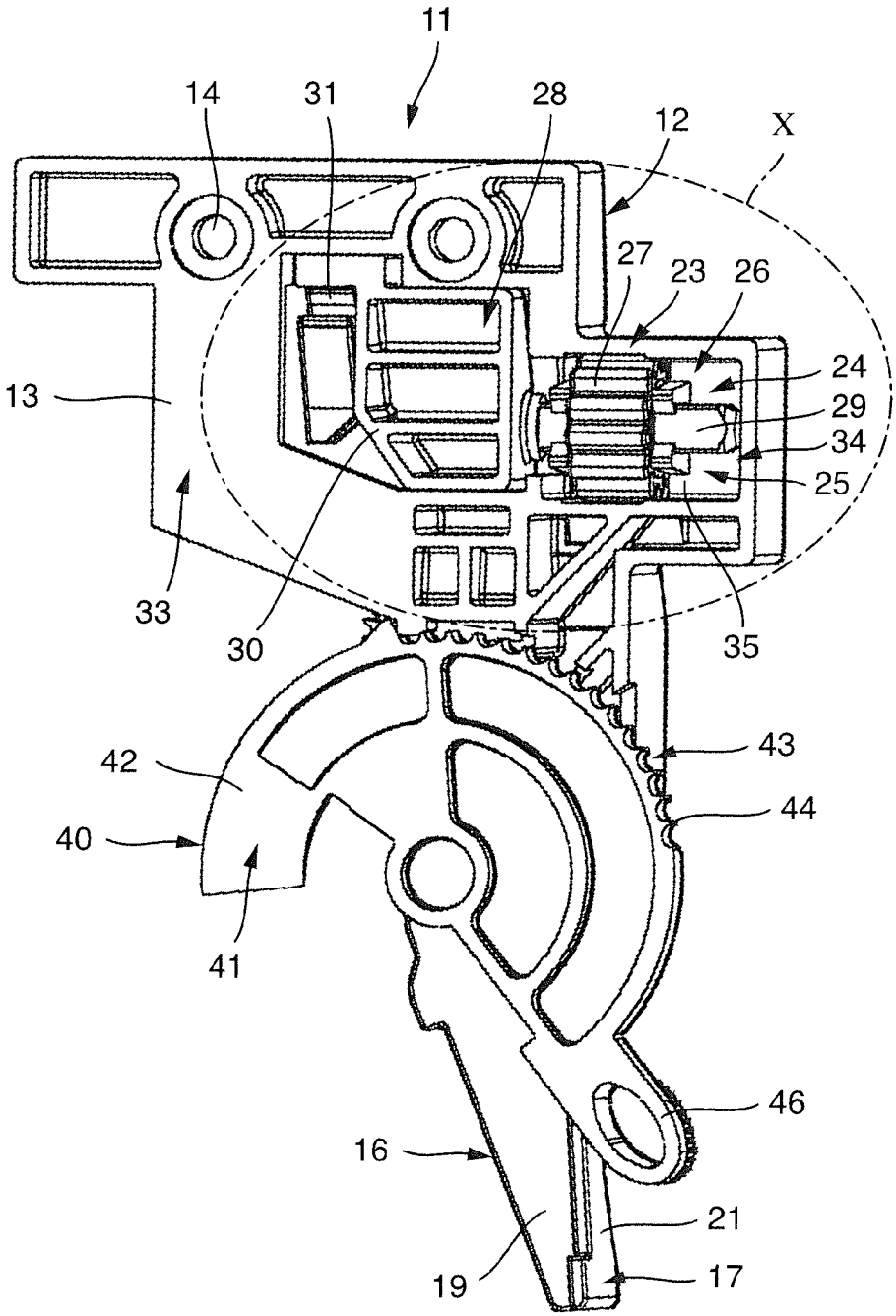
FIG. 2 is a plan view of the assembly side of the device of FIG. 1.

As illustrated in particular in FIG. 2, the base portion 30 of the coupling member 28 is constructed as a hollow member which in the example shown is reinforced by ribs which extend in the longitudinal direction of the threaded shaft 29. This leads to a saving of material during the production of the coupling member 28.

As shown in particular in FIG. 1, the wedge-like coupling portion 31 has a receiving slot 32 which extends transversely, in particular perpendicularly, relative to the longitudinal axis of the threaded shaft 29. The receiving slot 32 serves to receive a receiving portion of the guidance unit, in particular a wall portion of a runner or drawer rail of the guidance unit.

The preassembled subassembly 24 comprising the coupling member 28 and adjustment element 27, that is to say, in particular of the adjustment wheel which is screwed on the threaded shaft 29, can be secured as a unit to the securing interface 25 of the base portion 12. The securing interface 25 is located at an assembly side 33 of the base portion 12 associated with the drawer member. The securing interface 25 has a bearing receiving member 34 which is constructed on the base portion 12 for supporting the subassembly 24.

As illustrated in particular in FIG. 2, the bearing receiving member 34 is arranged in a recess 35 which is constructed in a recessed manner at the assembly side 33.

A characteristic aspect of the bearing receiving member 34 is a catch mechanism that enables a tool-free engagement of the subassembly 24.

Figure 4:
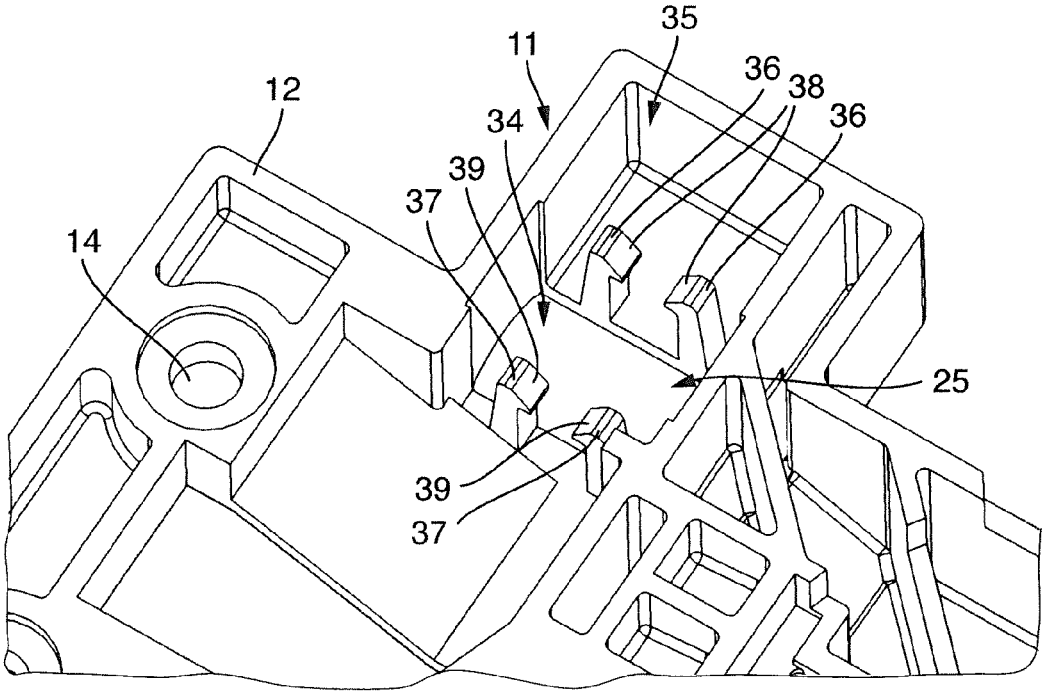
FIG. 4 is an enlarged illustration of the detail X from FIG. 2 with a non-assembled subassembly.

As shown in particular in FIG. 4, the catch mechanism has at least two resilient catch webs 36, 37 which protrude away from the base portion 12 and which are arranged facing each other and which have catch projections 38, 39 which project towards each other. In the example, four catch webs 36, 37 are provided, of which two are arranged in pairs facing each other. The catch webs 36, 37 with the catch projections 38, 39 which project towards each other are constructed in such a manner that the catch webs 36, 37 which are associated with each other in pairs are pressed outwards in each case when the subassembly 24 is introduced and, after the associated subassembly 24 has passed the catch projections 38, 39, snap back again, wherein the catch projections 38, 39 engage behind the associated component of the subassembly 24 and secure it to the base portion 12.

Figure 5:
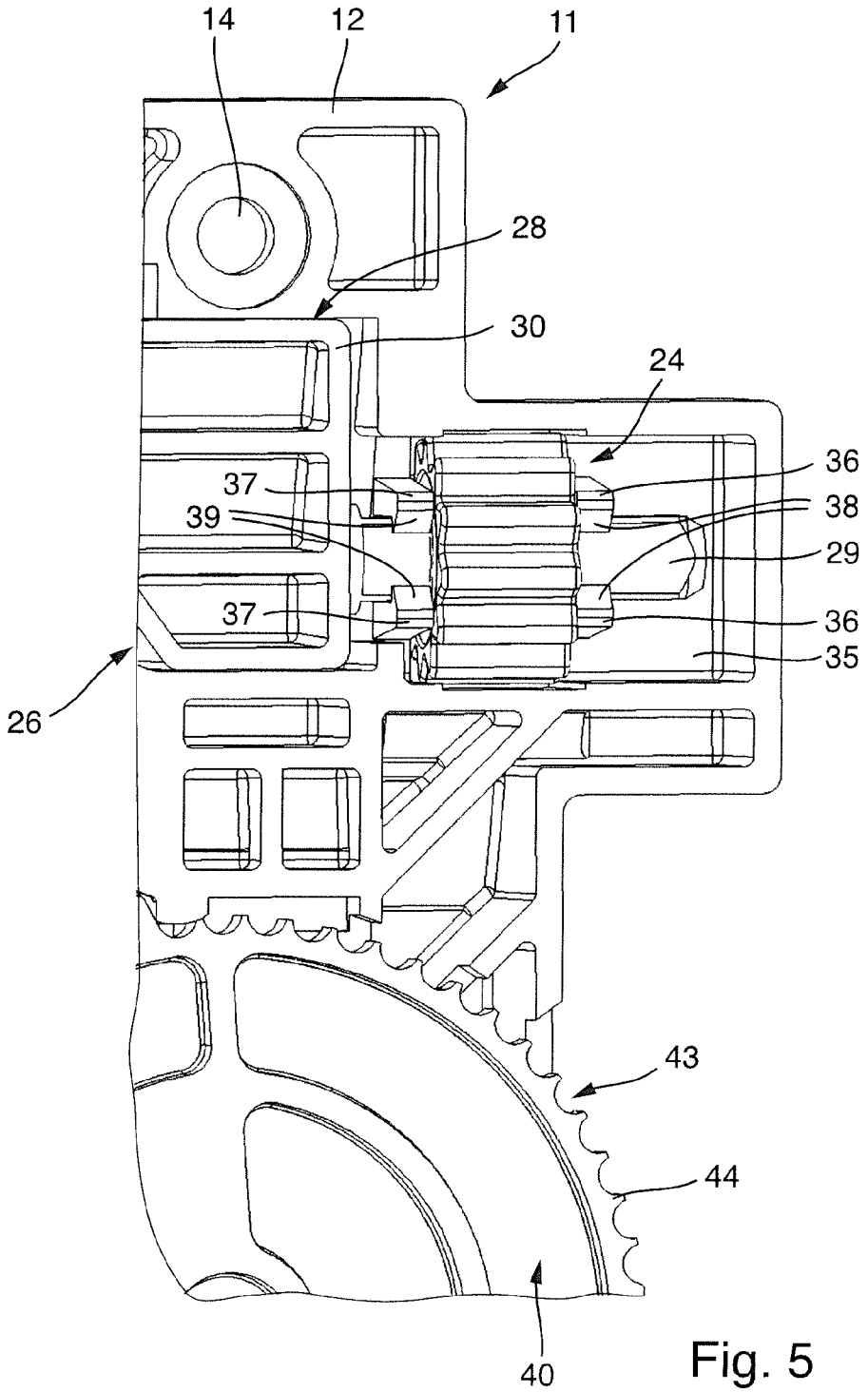
FIG. 5 is an enlarged illustration of the detail X from FIG. 2 with an assembled subassembly.

As shown in particular in FIG. 5, the threaded shaft 29 of the coupling member 28 is received in the bearing receiving member 34 which is formed by the catch webs 36, 37. The catch webs 36, 37 in this instance flank at both sides the adjustment wheel which consequently remains fixed in position with respect to the base portion 12 when a rotation movement is initiated and in this instance enables a linear movement of the threaded shaft with the coupled coupling portion 31 in one direction or the other.

As illustrated in particular in FIG. 1, the adjustment device further has a height adjustment unit 40 for adjusting the position of the drawer member relative to the guidance unit in a vertical direction. The height adjustment unit 40, as illustrated in particular in FIGS. 1 and 2, has a wedge-like, substantially semi-circular ramp 41 which is supported so as to be pivotably movable about a pivot axis 42 at the assembly side 33 of the base portion 12 in the region of the bearing portion 16. The effective wedge face 42 of the ramp 41 engages in the intermediate space between the upper side of the drawer rail or runner rail and the drawer base. The ramp 41 can be adjusted by a handle 43 which is located on the ramp 41 and which protrudes radially outwards, whereby a portion of the wedge face 42 which is either larger or smaller in the vertical direction protrudes into the intermediate space and consequently leads to an increase or decrease of the spacing between the drawer base and the runner rail, whereby the drawer member can be adjusted in the vertical direction.

As shown in particular in FIG. 2, there is provided on the outer periphery of the semi-circular ramp 41 a catch 43 having a large number of catch teeth 44 which cooperate with projections which are formed on the base plate 13. It is thereby possible to fix the adjusted position of the height adjustment unit 40.

For assembly, the subassembly 24 comprising the coupling member 28 and adjustment element 27 is clip-fitted into the bearing receiving member 34, in which the threaded shaft 29 is moved towards the catch webs 36, 37 so that it presses apart the catch webs 36, 37 which are arranged in respective pairs. After passing the catch projections 38, 39 the catch webs 36, 37 snap back into their original position again so that the threaded shaft 29 and therefore the entire subassembly 24 is secured to the bearing receiving member 34. As already mentioned, the adjustment wheel is located between the two catch web pairs.

Figure 3:
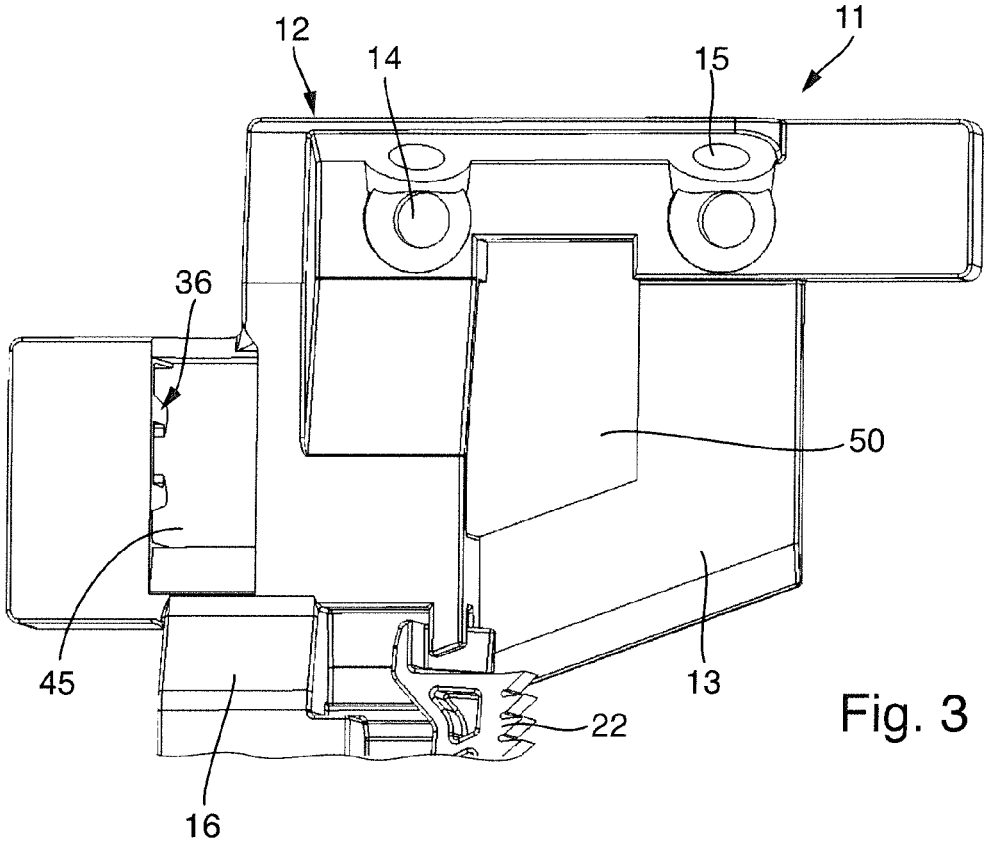
FIG. 3 is an enlarged illustration of the operating side of the device of FIG. 1 opposite the assembly side.

As shown in particular in FIG. 3, the base portion 12 further has a window-like recess 50 through which the wedge-like coupling portion 31 protrudes from the assembly side 33 into the operating side. There is further provided an additional opening 45 through which the adjustment wheel protrudes into the operating side. Afterwards, the device 11 can be assembled on the drawer base. In this instance, the recess with the bearing receiving member 34 is covered by the drawer base. Next, the drawer member can be coupled to the associated guide rail, that is to say, the drawer rail in which the wall portion of the drawer rail is introduced into the receiving slot of the wedge-like coupling portion 31 of the coupling member 28. The mutually complementary catch teeth 22 on the engagement portion 20 and on the drawer rail move into engagement with each other, whereby the drawer member is coupled to the runner rail.

In order to adjust the lateral position of the drawer member, a movement of the threaded shaft can be produced in one direction or the other by rotating the adjustment wheel, whereby the drawer member is adjusted in relative terms with respect to the drawer rail.

What is claimed is:

1. An item of furniture, comprising:

a furniture drawer moveably connected to a furniture body and guided in the furniture body by a guidance unit;

a connecting device releasably connecting the furniture drawer to the guidance unit;

a base portion of the connecting device; and a displacement device arranged on the base portion and comprising a plurality of components moveable relative to each other, the displacement device enabling a position of the furniture drawer to be adjusted in at least one spatial direction relative to the guidance unit, wherein the components of the displacement device are arranged as a preassembled subassembly that is releasably securable to the base portion at a securing interface, wherein the securing interface has a bearing receiving member disposed on the base portion to support the subassembly, wherein the bearing receiving member includes a catch mechanism for tool-free engagement of the subassembly, wherein the catch mechanism includes four resilient catch webs that protrude away from the base portion of which, respectively, two pairwise catch webs are arranged so as to face each other, and that have catch projections that protrude towards each other such that the catch webs are pressed outwards when an associated component of the subassembly is introduced and, after the associated component has passed the catch projections, snap back again, wherein the catch projections engage behind the associated component and secure the associated component to the base portion, and wherein the base portion has a recess in which the bearing receiving member is arranged, wherein the displacement device includes a lateral displacement unit to adjust the position of the furniture drawer relative to the guidance unit transversely relative to a longitudinal direction of the guidance unit, the lateral displacement unit comprising an adjustment element and a coupling member moveable relative to the adjustment element and which is capable of being coupled to the guidance unit for lateral displacement of the furniture drawer with respect to the guidance unit, wherein the adjustment element comprises an adjustment wheel and the coupling member has a threaded shaft on which the adjustment wheel is screwed, wherein the subassembly is securable to the base portion at the securing interface, wherein the base portion has an assembly side associated with the furniture drawer and on which the securing interface is located, wherein the base portion is assembled with the assembly side on a drawer base of the furniture drawer, wherein the securing interface is covered by the drawer base, wherein the base portion comprises an operating side formed on a side of the base portion opposite the assembly side, and wherein the base portion comprises an opening through which the adjustment wheel protrudes into the operating side.

2. The item of furniture according to claim 1, wherein the securing interface on the base portion is configured for tool-free releasable securing of the subassembly.

3. The item of furniture according to claim 1, wherein the base portion and/or the subassembly comprises injection-molded plastic components.

4. The item of furniture according to claim 3, wherein the catch webs of the bearing receiving member are integrally formed on a remainder of the base portion.

* * * * *